US008365534B2

(12) United States Patent
Popovic et al.

(10) Patent No.: US 8,365,534 B2
(45) Date of Patent: Feb. 5, 2013

(54) GAS TURBINE COMBUSTOR HAVING A FUEL NOZZLE FOR FLAME ANCHORING

(75) Inventors: Predrag Popovic, Simpsonville, SC (US); Abinash Baruah, Bangalore (IN); Gilbert Otto Kraemer, Greer, SC (US); William Thomas Ross, Greer, SC (US)

(73) Assignee: General Electric Company, Schenectady, NY (US)

( * ) Notice: Subject to any disclaimer, the term of this patent is extended or adjusted under 35 U.S.C. 154(b) by 34 days.

(21) Appl. No.: 13/048,564

(22) Filed: Mar. 15, 2011

(65) Prior Publication Data

US 2012/0234011 A1 Sep. 20, 2012

(51) Int. Cl.

| | |
|---|---|
| ***F02C 7/22*** | (2006.01) |
| ***F23R 3/28*** | (2006.01) |
| ***F23D 14/22*** | (2006.01) |

(52) U.S. Cl. ..... 60/740; 60/742; 60/746

(58) Field of Classification Search ..... 60/740, 60/742, 746

See application file for complete search history.

(56) References Cited

U.S. PATENT DOCUMENTS

| | | | | |
|---|---|---|---|---|
| 3,600,891 | A | 8/1971 | Gordon | |
| 3,603,092 | A * | 9/1971 | Paine et al. | 60/258 |
| 3,630,024 | A | 12/1971 | Hopkins | |
| 3,658,249 | A | 4/1972 | Sharpe | |
| 3,684,186 | A | 8/1972 | Helmrich | |
| 3,718,258 | A | 2/1973 | Sharpe | |
| 3,938,324 | A | 2/1976 | Hammond, Jr. et al. | |
| 3,954,389 | A | 5/1976 | Szetela | |
| 4,105,163 | A | 8/1978 | Davis, Jr. et al. | |
| 4,261,517 | A | 4/1981 | Hopkins et al. | |
| 4,362,021 | A | 12/1982 | Willis | |
| 4,395,874 | A | 8/1983 | Striebel et al. | |
| 4,418,543 | A | 12/1983 | Faucher et al. | |
| 4,429,538 | A | 2/1984 | Sato et al. | |
| 4,595,143 | A | 6/1986 | Simmons et al. | |
| 4,763,482 | A | 8/1988 | Wehner | |
| 4,801,092 | A * | 1/1989 | Webber et al. | 239/418 |
| 4,884,746 | A | 12/1989 | Lewis | |
| 4,941,617 | A | 7/1990 | Russell | |
| 5,104,310 | A | 4/1992 | Saltin | |
| 5,156,002 | A | 10/1992 | Mowill | |
| 5,165,241 | A | 11/1992 | Joshi et al. | |
| 5,251,447 | A | 10/1993 | Joshi et al. | |

(Continued)

FOREIGN PATENT DOCUMENTS

| | | |
|---|---|---|
| EP | 0148599 A3 | 7/1985 |
| EP | 0378505 B1 | 3/1994 |

(Continued)

*Primary Examiner* — Ted Kim
(74) *Attorney, Agent, or Firm* — Cantor Colburn LLP

(57) ABSTRACT

A combustor includes an end cover having a nozzle. The nozzle has a front end face and a central axis. The nozzle includes a plurality of fuel passages and a plurality of oxidizer passages. The fuel passages are configured for fuel exiting the fuel passage. The fuel passages are positioned to direct fuel in a first direction, where the first direction is angled inwardly towards the center axis. The oxidizer passages are configured for having oxidizer exit the oxidizer passages. The oxidizer passages are positioned to direct oxidizer in a second direction, where the second direction is angled outwardly away from the center axis. The plurality of fuel passages and the plurality of oxidizer passages are positioned in relation to one another such that fuel is in a cross-flow arrangement with oxidizer to create a burning zone in the combustor.

18 Claims, 7 Drawing Sheets

U.S. PATENT DOCUMENTS 5,251,823 A 10/1993 Joshi et al.
5,323,604 A 6/1994 Ekstedt et al.
5,357,743 A 10/1994 Zarzalis et al.
5,359,847 A 11/1994 Pillsbury et al.
5,373,693 A 12/1994 Zarzalis et al.
5,394,688 A 3/1995 Amos
5,479,782 A 1/1996 Parker et al.
5,481,866 A 1/1996 Mowill
5,490,378 A 2/1996 Berger et al.
5,511,375 A 4/1996 Joshi et al.
5,579,645 A 12/1996 Prociw et al.
5,590,529 A 1/1997 Joshi et al.
5,596,873 A 1/1997 Joshi et al.
5,603,211 A 2/1997 Graves
5,605,287 A 2/1997 Mains
5,613,363 A 3/1997 Joshi et al.
5,638,682 A 6/1997 Joshi et al.
5,675,971 A 10/1997 Angel et al.
5,680,766 A 10/1997 Joshi et al.
5,778,676 A 7/1998 Joshi et al.
5,865,024 A 2/1999 Kress et al.
5,873,237 A 2/1999 Medla et al.
5,966,937 A 10/1999 Graves
5,983,642 A 11/1999 Parker et al.
5,987,889 A 11/1999 Graves et al.
6,050,082 A 4/2000 Leonard et al.
6,092,738 A 7/2000 Becker
6,102,692 A 8/2000 Dobbeling et al.
6,112,511 A 9/2000 Myers
6,123,273 A 9/2000 Loprinzo et al.
6,141,967 A 11/2000 Angel et al.
6,161,387 A 12/2000 Green
6,195,607 B1 2/2001 Rajamani et al.
6,272,842 B1 8/2001 Dean
6,276,924 B1 8/2001 Joshi et al.
6,286,302 B1 9/2001 Farmer et al.
6,311,473 B1 11/2001 Benjamin et al.
6,345,505 B1 2/2002 Green
6,363,726 B1 4/2002 Durbin et al.
6,381,964 B1 5/2002 Pritchard, Jr. et al.
6,389,815 B1 5/2002 Hura et al.
6,419,480 B2 7/2002 Al-Halbouni
6,434,945 B1 * 8/2002 Mandai et al. ..... 60/740
6,449,953 B1 9/2002 Hook, Jr. et al.
6,457,316 B1 10/2002 Czachor et al.
6,536,206 B2 3/2003 Hook, Jr. et al.
6,735,949 B1 5/2004 Haynes et al.
6,761,033 B2 7/2004 Inoue et al.
6,802,178 B2 * 10/2004 Sprouse et al. ..... 60/746
6,832,481 B2 12/2004 Koenig et al.
6,871,503 B1 3/2005 Inoue et al.
6,951,108 B2 10/2005 Burrus et al.
7,143,583 B2 * 12/2006 Hayashi et al. ..... 60/747
7,287,382 B2 * 10/2007 Henriquez ..... 60/746
7,464,553 B2 12/2008 Hsieh et al.
7,581,396 B2 9/2009 Hsieh et al.
8,042,339 B2 * 10/2011 Lacy et al. ..... 60/740
2006/0236700 A1 * 10/2006 Saitoh et al. ..... 60/748
2008/0078160 A1 * 4/2008 Kraemer et al. ..... 60/204
2008/0083229 A1 * 4/2008 Haynes et al. ..... 60/740
2008/0098736 A1 5/2008 Lee et al.
2008/0148736 A1 6/2008 Ishizaka et al.
2008/0289341 A1 11/2008 Ishizaka et al.
2009/0100837 A1 * 4/2009 Von Der Bank ..... 60/740
2009/0126687 A1 5/2009 Paterson
2009/0139237 A1 6/2009 Sullivan et al.
2009/0223227 A1 9/2009 Lipinski et al.
2010/0058767 A1 3/2010 Simons et al.
2010/0170253 A1 7/2010 Berry et al.
2010/0205971 A1 8/2010 Williams et al.

FOREIGN PATENT DOCUMENTS

EP 0905443 A2 3/1999
EP 0905443 A3 6/1999
EP 0895024 A3 7/1999
EP 1041344 A1 10/2000
EP 1193450 A1 4/2002
EP 0895024 B1 1/2003
EP 0999411 B1 11/2004
EP 0905443 B1 12/2004
EP 1030112 B1 7/2005
EP 1921381 A2 5/2008
EP 1193448 B1 12/2008
WO WO98/33012 7/1998
WO WO99/19674 4/1999

* cited by examiner

GAS TURBINE COMBUSTOR HAVING A FUEL NOZZLE FOR FLAME ANCHORING

BACKGROUND OF THE INVENTION

The subject matter disclosed herein relates to a combustor for a gas turbine, and more specifically to a combustor where oxidizer and fuel are injected by a fuel nozzle that creates a recirculation zone for anchoring a burning zone.

Gas turbines generally include a compressor, a combustor, one or more fuel nozzles, and a turbine. Working fluid enters the gas turbine through an intake and is pressurized by the compressor. The working fluid may be pure air or low-oxygen or oxygen-deficient content working fluid. Some examples of a low-oxygen content working fluid include, for example, a carbon dioxide and steam based mixture and a carbon-dioxide and nitrogen based mixture. The compressed working fluid is then mixed with fuel supplied by the fuel nozzles. The working fluid-fuel oxidizer mixture is supplied to the combustors at a specified ratio for combustion. The oxidizer may be air, pure oxygen, or an oxygen enriched fluid. The combustion generates pressurized exhaust gases, which drive the blades of the turbine.

The combustor includes a burning zone, a recirculation zone or bubble, and a dilution zone. An end cover of the combustor typically includes one or more fuel nozzles. In an effort to provide stable and efficient combustion, sometimes a pilot burner or nozzle can be provided in the end cover as well. The pilot nozzle is used to initiate a flame in the burning zone. Fuel is evaporated and partially burned the in the recirculation bubble, and the remaining fuel is burned in the burning zone. Removing or reducing the recirculation bubble results in the working fluid-flow mixture expanding within the combustor, which decreases residence time of the working fluid-fuel mixture.

The presence of a strong recirculation bubble can be especially important in stoichiometric diffusion combustion applications where a low-oxygen or oxygen-deficient content working fluid is employed such as, for example, during oxy-fuel combustion. When combusting in low-oxygen working fluid applications, it is important that combustion is complete before a significant amount of fuel and oxidizer escape the flame zone. A strong recirculation bubble with a secondary small recirculation will ensure that increasing residence time in the flame zone will achieve high combustion efficiency. Therefore, it would be desirable to provide a fuel nozzle that promotes stable and efficient combustion, especially in applications where a low-oxygen content working fluid is employed.

BRIEF DESCRIPTION OF THE INVENTION

According to one aspect of the invention, a combustor for a gas turbine includes an end cover having a nozzle. The nozzle has a front end face and a central axis. The nozzle includes a plurality of fuel passages and a plurality of oxidizer passages. The plurality of fuel passages are configured for fuel exiting the fuel passage. The plurality of fuel passages are positioned to direct fuel in a first direction, where the first direction is angled inwardly towards the center axis. The plurality of oxidizer passages for having oxidizer exit the plurality of oxidizer passages. The plurality of oxidizer passages are positioned to direct oxidizer in a second direction, where the second direction is angled outwardly away from the center axis. The plurality of fuel passages and the plurality of oxidizer passages are positioned in relation to one another such that fuel is in a cross-flow arrangement with oxidizer to create a burning zone in the combustor. The plurality of oxidizer passages are configured to direct oxidizer to create a recirculation zone in the combustor that anchors the burning zone at the front end face of the nozzle.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
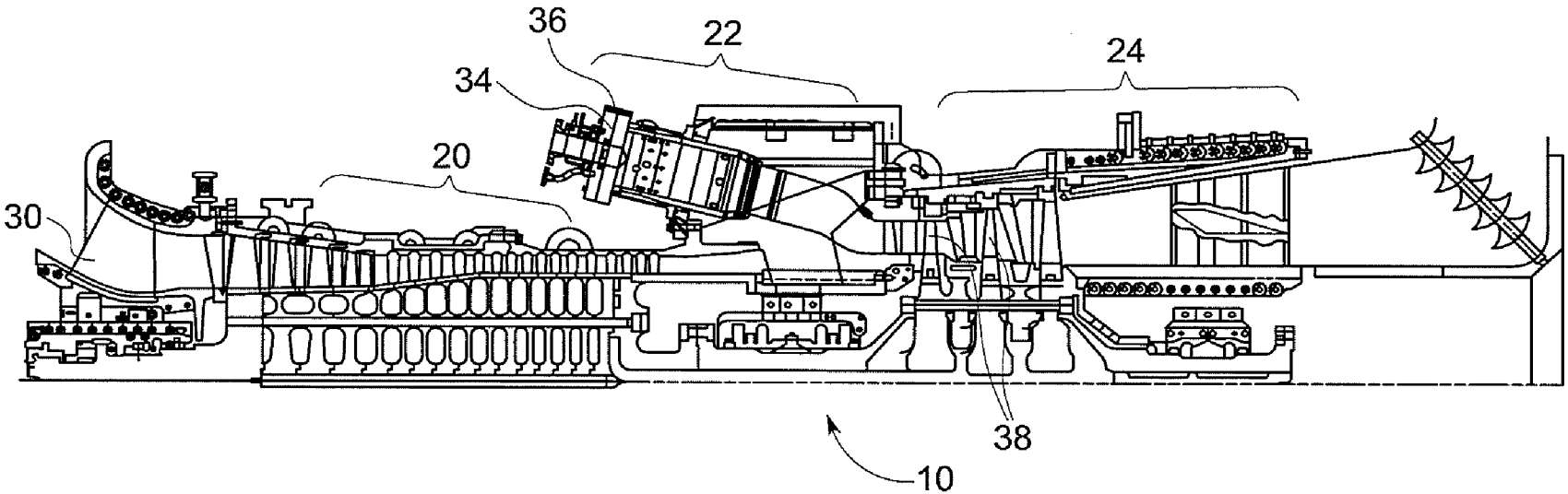
FIG. 1 is a partially cross-sectioned view of an exemplary gas turbine system having a combustor.

FIG. 1 illustrates an exemplary power generation system indicated by reference number 10. The power generation system 10 is a gas turbine system having a compressor 20, a combustor 22, and a turbine 24. Working fluid enters the power generation system 10 though an air intake 30 located in the compressor 20, and is pressurized by the compressor 20. The compressed working fluid is then mixed with fuel by a fuel nozzle 34 located in an end cover 36 of the combustor 22. The fuel nozzle 34 injects a working fluid-fuel-oxidizer mixture into the combustor 22 in a specific ratio for combustion. The combustion generates hot pressurized exhaust gases that drives blades 38 that are located within the turbine 24.

Figure 2:
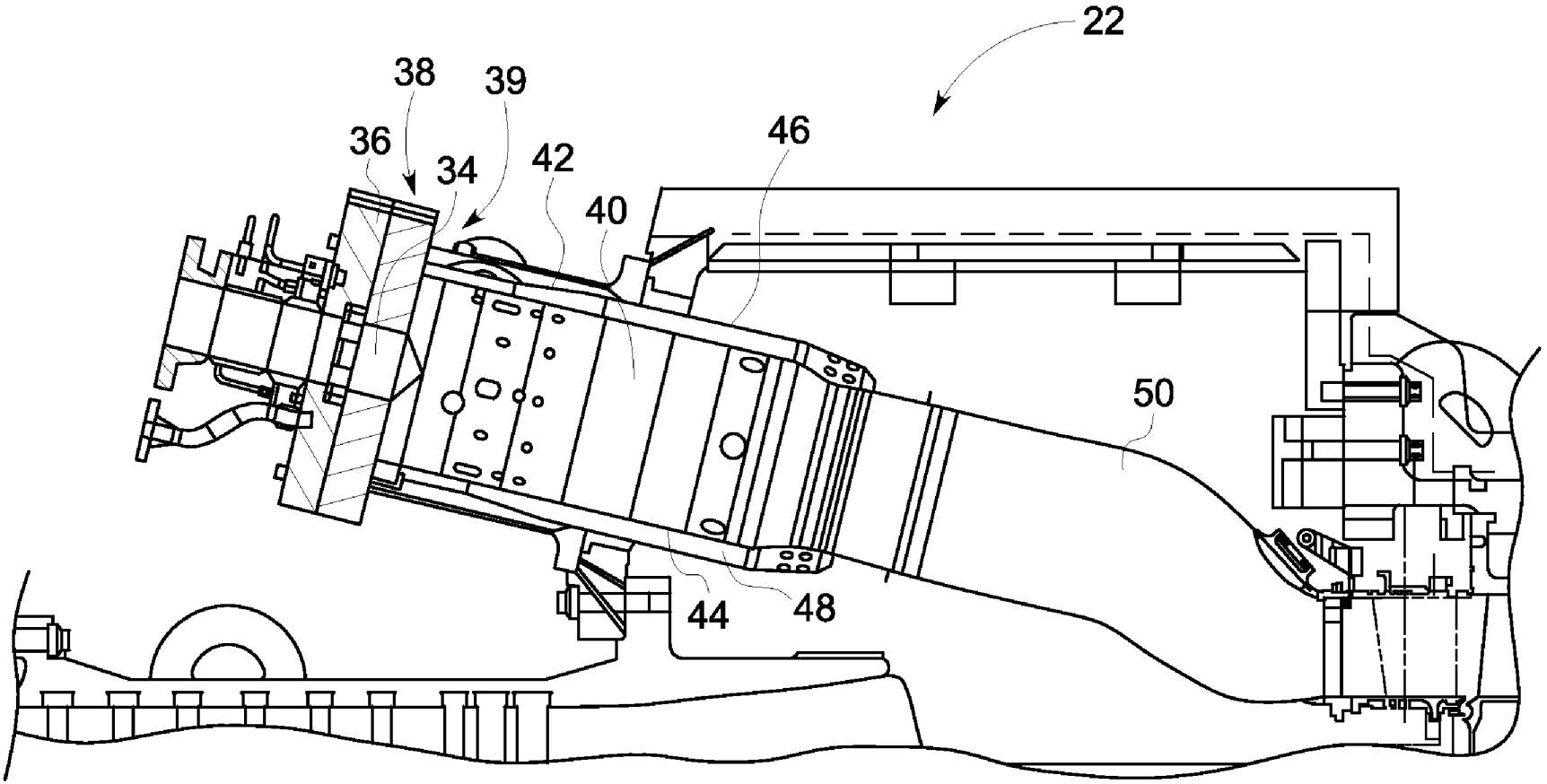
FIG. 2 is a cross-sectioned view of the combustor illustrated in FIG. 1, where the combustor has a fuel nozzle attached to an end cover.

FIG. 2 is an enlarged view of the combustor 22 shown in FIG. 1. The end cover 36 is located at a base 39 of the combustor 22. Compressed working fluid and fuel are directed though the end cover 36 and to the nozzle 34, which distributes a working fluid-fuel mixture into the combustor 22. The combustor 22 includes a chamber 40 that is defined by a casing 42, liner 44, and a flow sleeve 46. In the exemplary embodiment as shown, the liner 44 and the flow sleeve 46 are co-axial with one another to define a hollow annular space 48 that allows for the passage of working fluid for cooling. The casing 42, liner 44 and flow sleeve 46 may improve flow of hot gases though a transition piece 50 of the combustor 22 and towards the turbine 24. In the exemplary embodiment as shown, a single nozzle 34 is attached to the end cover 36, and the combustor 22 is part of a can-annular gas turbine arrangement. Although FIG. 1 illustrates a single nozzle 34, it is understood that a multiple nozzle configuration may be employed as well within the combustor 22.

Figure 3:
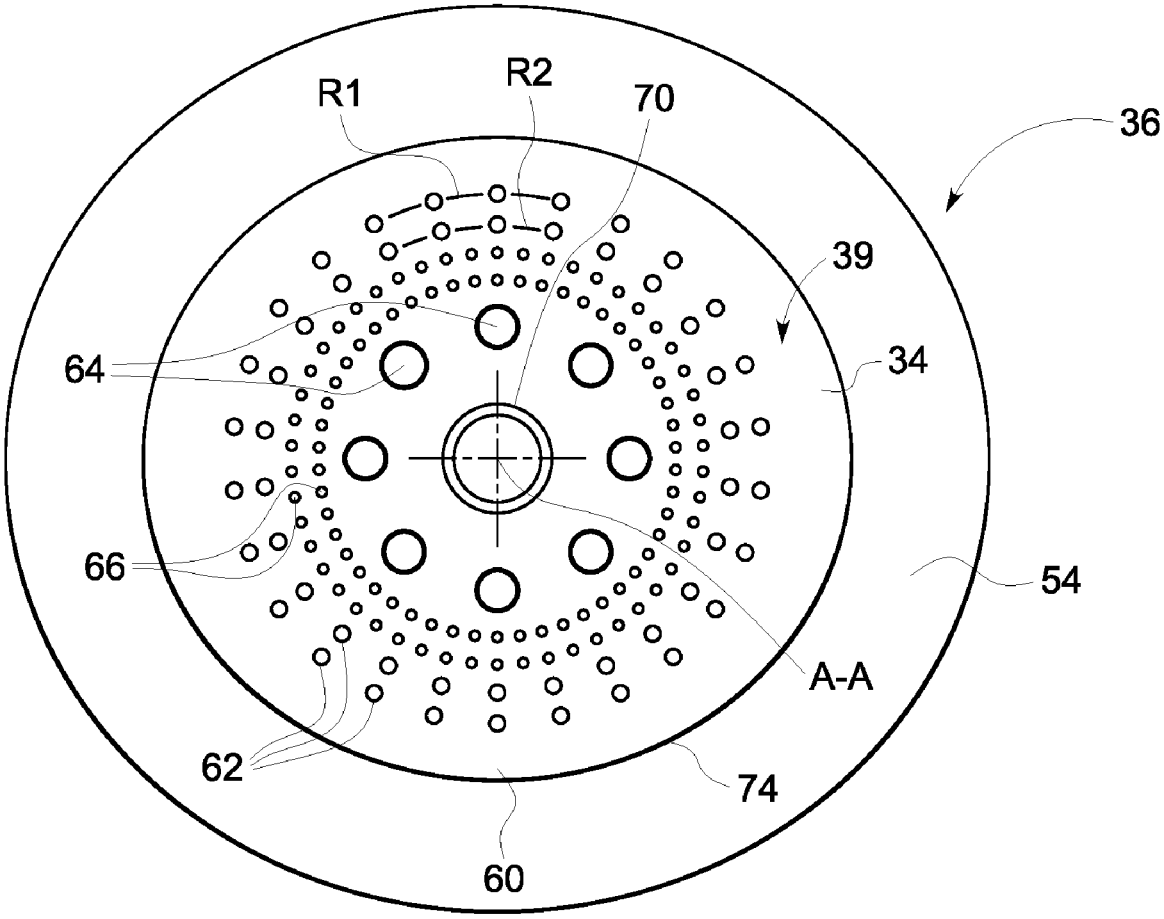
FIG. 3 is a front view of the end cover and the fuel nozzle shown in FIG. 2.

Turning now to FIG. 3, an illustration of the end cover 36 and the fuel nozzle 34 is shown. The fuel nozzle 34 is attached to a base or end cover surface 54 of the end cover 36. Specifically, the fuel nozzle 34 may be defined through an end cap liner 56 (shown in FIG. 5). The fuel nozzle 34 is used to supply a working fluid-fuel mixture into the combustor 22 in a specific ratio for combustion. The fuel nozzle 34 has a front end face 60 and includes a plurality of fuel passages 62, a plurality of oxidizer passages 64, and a plurality of cooling flow passages 66. In the embodiment as shown, a pilot burner or nozzle 70 is also provided with the fuel nozzle 34 and is located along a center axis A-A of the fuel nozzle 34. The fuel passages 62, oxidizer passages 64, and cooling flow passages 66 are all arranged around the pilot nozzle 70 in a symmetrical pattern. The oxidizer passages 64 are located adjacent to the pilot nozzle 70. The cooling flow passages 66 are located between the oxidizer passages 64 and the fuel passages 62. The fuel passages 62 are located adjacent to an outer edge 74 of the fuel nozzle 34.

Figure 4:
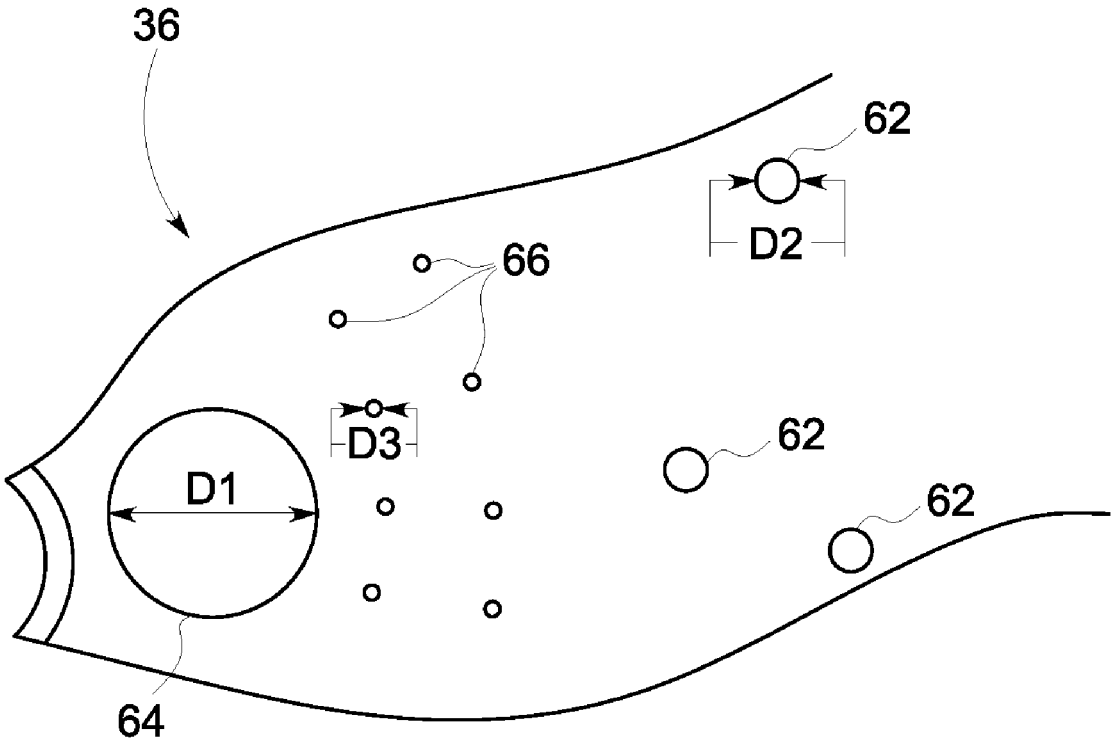
FIG. 4 is an enlarged view of a portion of the end cover shown in FIG. 3.

FIG. 4 is an enlarged view of a portion of the end cover 36. In the exemplary embodiment as shown, each of the oxidizer passages 64 have an outer diameter D1, each of the fuel passages 62 have an outer diameter D2, and each of the cooling flow passages 66 have an outer diameter D3. The outer diameter D1 of the oxidizer passages 64 is greater than both the outer diameter D2 of the fuel passages 62 and the diameter D3 of the cooling flow passages 66. The diameter D2 of the fuel passages 62 is greater than the outer diameter D3 of the cooling flow passages 66. In one exemplary embodiment, three fuel passages 62 are provided for each oxidizer passage 64, and several cooling passages 66 are supplied for each fuel passage 62. However, it is understood that any number of fuel nozzles 62, oxidizer passages 64, and cooling flow passages 66 can be provided depending on the specific application.

Figure 5:
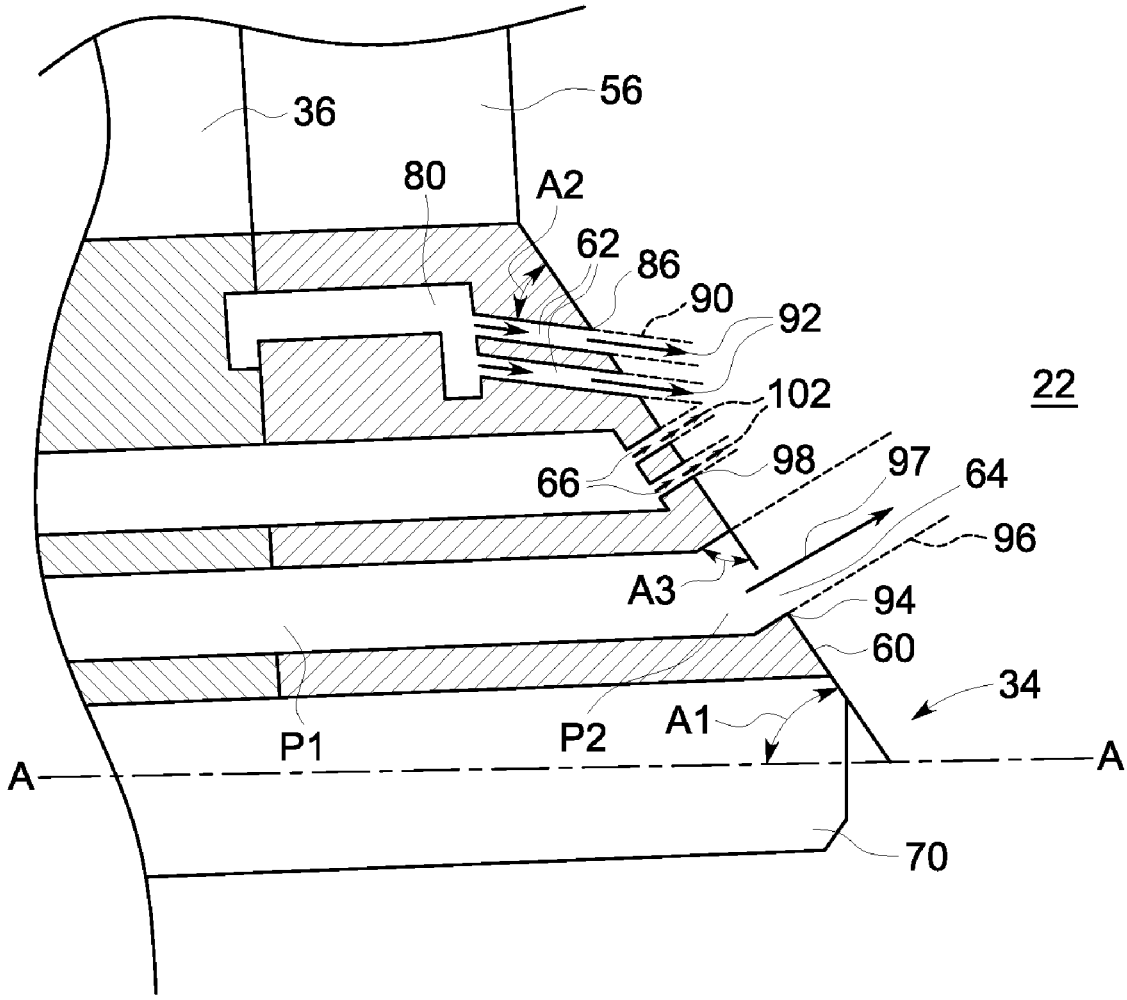
FIG. 5 is a cross-sectioned view of the fuel nozzle shown in FIG. 3.

Turning now to FIG. 5, a cross-sectional view of a portion of the end cover 36 is shown with the fuel passages 62, the oxidizer passages 64, and the cooling flow passages 66 defined through the end cap liner 56. Specifically, the fuel passages 62, the oxidizer passages 64, and the cooling flow passages 66 are each angled within the end cap liner 56 with respect to the central axis A-A of the fuel nozzle 34. The front end face 60 of the fuel nozzle 34 includes an angular outer profile. Specifically, FIG. 5 illustrates the front end face 60 oriented at a end face angle A1 that is measured between the center axis A-A and the front end face 60. In one exemplary embodiment, the end face angle A1 of the front end face 60 ranges from about thirty degrees to about seventy-five degrees.

The fuel passages 62 are in fluid communication with and are supplied with fuel from a corresponding nozzle body 80 that is located within the end cap liner 56. Fuel exits the fuel passage 62 through a fuel opening 86 located on the front end face 60 of the fuel nozzle 34, and enters the combustor 22 as a fuel stream 90. The fuel passages 62 are each positioned at a fuel angle A2 within the end cap liner 56 to direct the fuel stream 90 in a first direction 92. The first direction 92 is angled inwardly towards the center axis A-A of the fuel nozzle 34 to direct the fuel stream 90 towards the center axis A-A of the fuel nozzle 34. In one exemplary embodiment, the fuel angle A2 of the fuel passages 62 ranges between about fifteen degrees to about ninety degrees when measured with respect to the front end face 60 of the fuel nozzle 34.

The oxidizer passages 64 are each in fluid communication with an oxidizer source (not shown). Oxidizer exits the oxidizer passage 64 through an oxidizer opening 94 located on the front end face 60 of the fuel nozzle 34, and enters the combustor 22 as an oxidizer stream 96. The oxidizer passages 64 include a first portion P1 that runs generally parallel with respect to the center axis A-A of the fuel nozzle 34, and a second portion P2 that is oriented at an oxidizer angle A3. The oxidizer angle A3 is measured with respect to the front end face 60 of the fuel nozzle 34. In the exemplary embodiment as illustrated, the oxidizer angle A3 is about normal or perpendicular with respect to the front end face 60. Therefore, the oxidizer angle A3 of each oxidizer passage 64 depends on the orientation of the front end face 60. The oxidizer passages 64 are each positioned at the oxidizer angle A3 to direct the oxidizer stream 96 in a second direction 97. The second direction 97 is angled outwardly away from the center axis A-A of the fuel nozzle 34 to direct the oxidizer stream 96 away from the center axis A-A of the fuel nozzle 34.

Referring now to both FIGS. 3-5, in one embodiment each of the oxidizer passages 66 have an outer diameter D1 that ranges between about 1.3 centimeters (0.5 inches) to about 3.8 centimeter (1.5 inches). The oxidizer passages 64 are angled outwardly from the center axis A-A of the fuel nozzle 34 at the oxidizer angle A3 to create a crown-like arrangement. In the embodiment as shown in FIG. 4, the fuel passages 62 are arranged in a staggered configuration with respect to one another. The fuel passages 62 are staggered in an effort to reduce the interaction between each of the nozzle bodies 80. The fuel passages 62 are also arranged to be in concentric rows of at least two. In the exemplary embodiment shown in FIG. 3, the fuel passages are arranged in two concentric rows R1 and R2.

Turning back to FIG. 5, the cooling flow passages 66 are in fluid communication with a source of working fluid (not shown). Working fluid exits the cooling flow passage 66 through a cooling flow opening 98 located on the front end face 60 of the fuel nozzle 34, and enters the combustor 22 as a working fluid stream 102. In the embodiment as illustrated, the cooling flow passages 64 are angled with respect to the center axis A-A of the fuel nozzle 34. The working fluid stream 102 typically enters the combustor 22 at a low velocity when compared to the velocities of the fuel stream 90 and the oxidizer stream 96, and can be a trickle or small stream of fluid. The working fluid stream 102 is employed to provide cooling to the fuel passages 62 and the oxidizer passages 64 during combustion. In one exemplary embodiment, a low-oxygen or oxygen-deficient content working fluid could be used. Some examples of a low-oxygen content working fluid include, for example, a carbon dioxide and steam based mixture, and a carbon dioxide and nitrogen based mixture.

Figure 6:
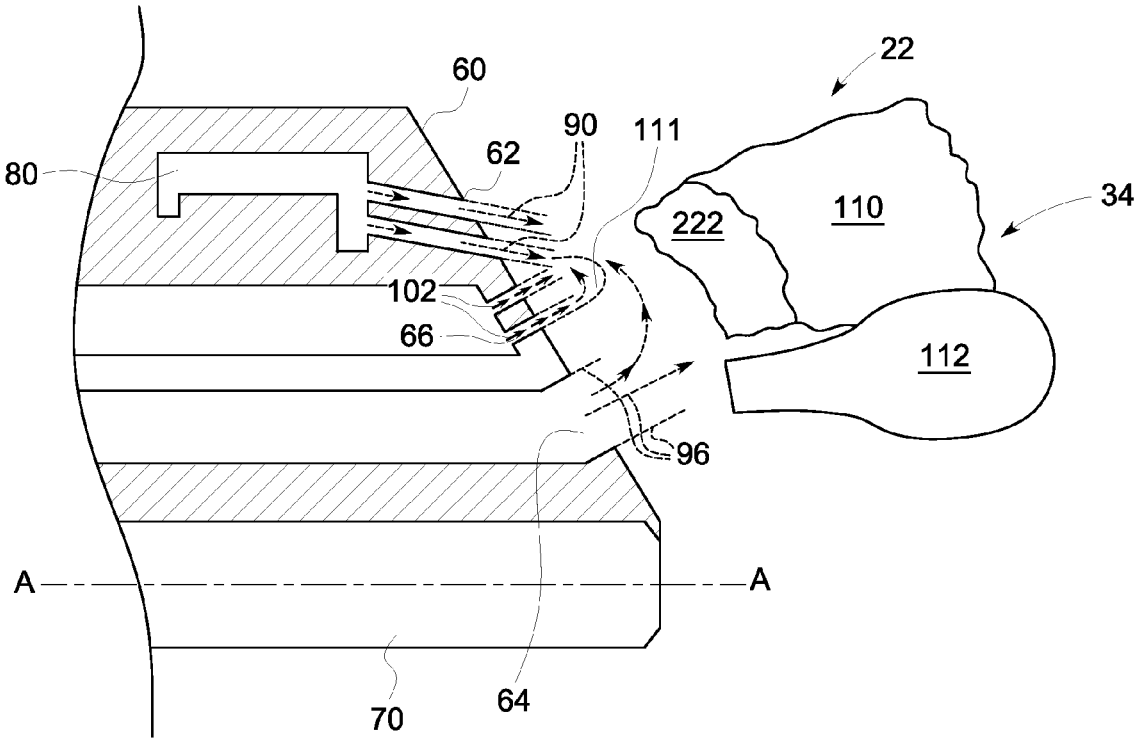
FIG. 6 is an illustration of the fuel nozzle shown in FIG. 5 during operation.

FIG. 6 is an illustration of the fuel nozzle 34 during operation of the combustor 22. The combustor includes a burning zone 110 and a recirculation zone or bubble 112. The pilot nozzle or igniter 70 may be used to initiate a flame in the burning zone 110. Fuel is evaporated and partially burnt the in the recirculation bubble 112, while the remaining fuel is burnt in the burning zone 110. The fuel stream 90 and the oxidizer stream 96 are in a cross-flow arrangement with one another to create the burning zone 110. Specifically, the fuel passages 62 and the oxidizer passages 64 are angled towards one another to cause the fuel stream 90 and the oxidizer stream 96 to mix together in a cross-flow arrangement. The reaction in the burning zone 110 is generally intensified when compared to some other applications because of the multitude of fuel passages 62 and oxidizer passages 64 located in the fuel nozzle 34 (shown in FIG. 3).

The working fluid stream 102 exits the cooling flow passage 66 and enters into the combustor 22 at a trickle. A portion of the working fluid stream 102 becomes entrained with a recirculation flow 111. The recirculation flow 111 is created by the fuel stream 90 and the oxidizer stream 96. This portion of the working fluid stream 102 is used to provide cooling and keeps the burning zone 110 away from the fuel nozzle body 80. The remaining amount of working fluid that does not mix with the recirculation flow 111 flows to the burning zone 110. The remaining amount of the working fluid stream 102 that reaches the burning zone 110 is used to control the flame temperature of the burning zone 110.

The flow of the oxidizer stream 96 from the oxidizer passages 64 creates a strong recirculation bubble 112 in the wake of the oxidizer stream 96 jets. The recirculation bubble 112 acts as a primary flame stabilization zone, which anchors the burning zone 110 to the front end face 60 of the fuel nozzle 34. The recirculation bubble 112 tends to compress the burning zone 110 within the combustor 22 towards the front end face 60 of the fuel nozzle 34. Compression of the burning zone 110 anchors the burning zone 110 closer to the front end face 60 of the injector nozzle 34. The recirculation bubble 112 acts as a primary flame stabilization mechanism, and the recirculation flow 111 acts as a secondary flame stabilization mechanism. The primary and secondary stabilization mechanisms re-circulate a portion of the fuel stream 62 and the oxidizer stream 64 to ensure stabilization of flame in the burning zone 110.

The recirculation bubble 112 and the secondary recirculation flow 111 are combined together to create a flame stabilization zone 222. The burning zone 110 is anchored to the front end face 60 of the injector nozzle 34 by the flame stabilization zone 222. Anchoring the burning zone 110 to the front end face 60 of the fuel nozzle 34 increases the residence time, which is important to achieve high combustion efficiency. A strong recirculation bubble can be especially important in stoichiometric diffusion combustion applications where a low-oxygen or oxygen-deficient content working fluid is employed, as a high combustion efficiency is needed for complete combustion. A weak or non-existent recirculation bubble will significantly reduce the residence time of the air-fuel mixture, resulting in an increased dilution of fuel and air to the working fluid.

Figure 7:
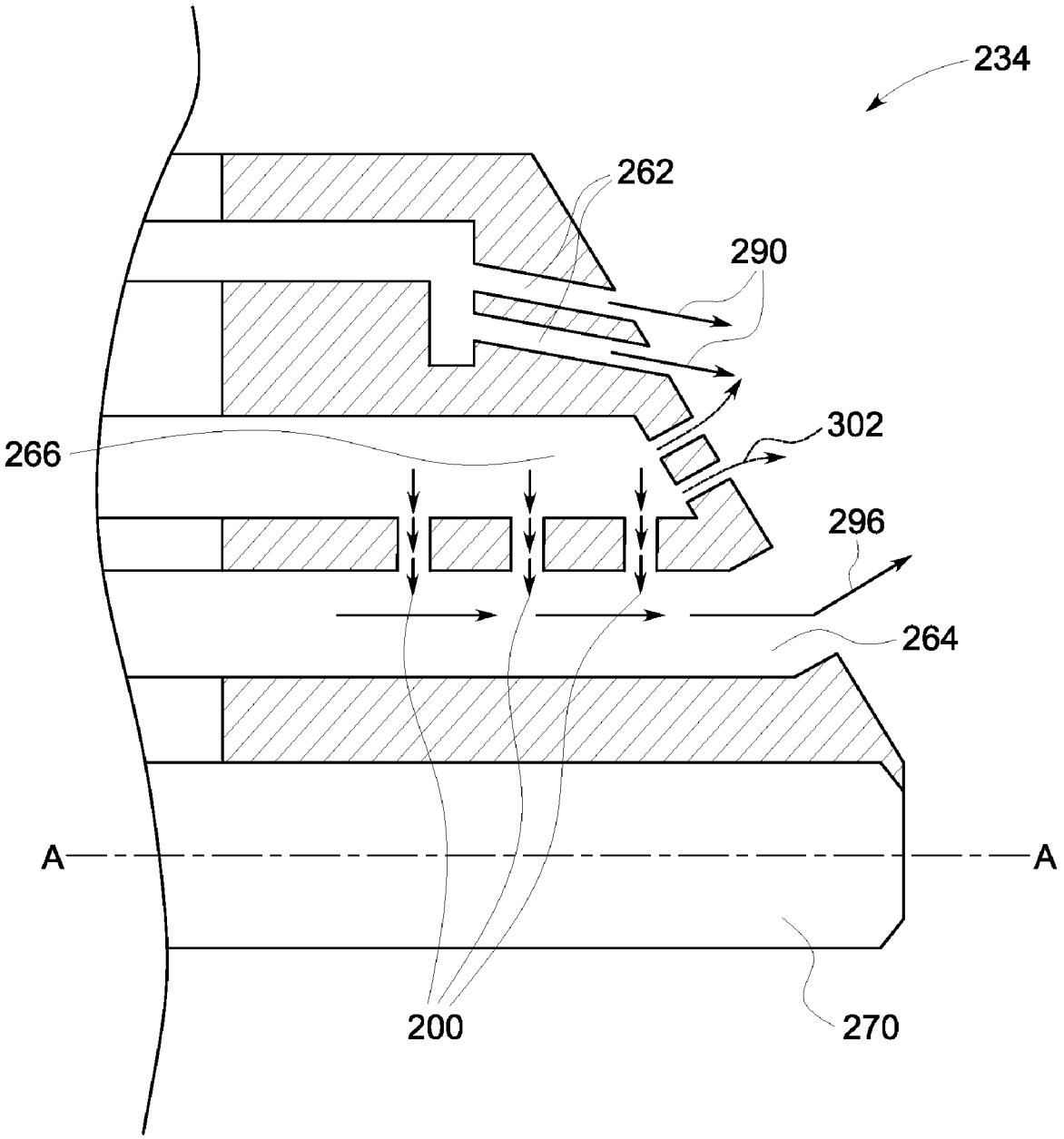
FIG. 7 is an alternative embodiment of the fuel nozzle shown in FIG. 5.

FIG. 7 is a cross-sectioned illustration of an alternative embodiment of a fuel nozzle 234. The fuel nozzle 234 includes fuel passages 262, oxidizer passages 264, cooling flow passages 266, and a pilot nozzle 270. In the embodiment as shown in FIG. 7, a plurality of mixing passages 200 are provided within an end cap liner 256 between the oxidizer passages 264 and the cooling flow passages 266, where the oxidizer passages 264 and the cooling flow passages 266 are fluidly connected to one another through the mixing passages 200. The passages 200 allow for a working fluid stream 302 to mix with an oxidizer stream 296 while both of the working fluid stream 302 and the oxidizer stream 296 are located within the fuel nozzle 234. Mixing the working fluid stream 302 with the oxidizer stream 296 will generally reduce the reactivity of the oxidizer stream 302 with a fuel stream 290, and can be used to control the flame reaction rates in the burning zone 110 (shown in FIG. 6). Reducing the reactivity of the oxidizer stream 302 will also assist in controlling the flame temperature of the burning zone 110.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor for a gas turbine, comprising:

an end cover having a nozzle, the nozzle having a front end face and a center axis, the front end face oriented at an inclined end face angle measured with respect to the center axis, the nozzle comprising:

a plurality of fuel passages configured for directing fuel in a first direction, wherein the first direction is angled inwardly towards the center axis, fuel exiting the plurality of fuel passages through respective openings located on the front end face;

a plurality of oxidizer passages configured for directing oxidizer in a second direction, wherein the second direction is angled outwardly away from the center axis, and wherein the plurality of fuel passages and the oxidizer passages are positioned in relation to one another such that fuel is in a cross-flow arrangement with oxidizer to create a burning zone in the combustor, oxidizer exiting the plurality of oxidizer passages through respective oxidizer opening located on the front end face, a pilot nozzle positioned at the central axis, the pilot nozzle initiating a flame in the burning zone, and wherein the plurality of oxidizer passages are configured to direct oxidizer to create a recirculation zone in the combustor that anchors the burning zone at the front end face of the nozzle, the recirculation zone being downstream of a point of intersection of the fuel and oxidizer from their respective passages.

2. The combustor of claim 1, wherein the nozzle includes a plurality of cooling flow passages configured for directing working fluid out of the plurality of cooling flow passages and into the combustor.

3. The combustor of claim 2, wherein a working fluid that is an oxygen-deficient working fluid is included with the combustor.

4. The combustor of claim 2, wherein a series of mixing passages are located within the end cover between the plurality of oxidizer passages and the plurality of cooling flow passages, and wherein the plurality of oxidizer passages and the plurality of cooling flow passages are fluidly connected to one another through the mixing passages.

5. The combustor of claim 1, wherein the plurality of oxidizer passages are oriented in an oxidizer angle measured with respect to the front end face of the fuel nozzle, wherein the oxidizer angle is about normal with respect to the front end face.

6. The combustor of claim 1, wherein the end face angle of the front end face ranges from about thirty degrees to about seventy-five degrees when measured from the center axis.

7. The combustor of claim 1, wherein the plurality of fuel passages are positioned at a fuel angle to orient fuel in the first direction, and wherein the fuel angle ranges between about fifteen degrees to about ninety degrees when measured with respect to the front end face of the fuel nozzle.

8. The combustor of claim 1, wherein the plurality of fuel passages are arranged in a staggered configuration with respect to one another along the front end face.

9. The combustor of claim 1, wherein the plurality of oxidizer passages include an outer diameter that ranges from between about 1.3 centimeter to about 3.8 centimeters.

10. A combustor for a gas turbine, the combustor comprising:

an end cover having at least one nozzle, the nozzle having a front end face and a center axis, the front end face oriented at an inclined end face angle measured with respect to the center axis, the nozzle comprising:

a plurality of fuel passages configured for directing fuel in a first direction, wherein the first direction is angled inwardly towards the center axis, fuel exiting the plurality of fuel passages through respective openings located on the front end face;

a plurality of cooling flow passages configured for directing working fluid out of one or more of the plurality of cooling flow passages and into the combustor;

a plurality of oxidizer passages configured for directing oxidizer in a second direction, the second direction being angled outwardly away from the center axis, and wherein the plurality of fuel passages and the plurality of oxidizer passages are positioned in relation to one another such that fuel is in a cross-flow arrangement with oxidizer to create a burning zone in the combustor, oxidizer exiting the plurality of oxidizer passages through respective oxidizer opening located on the front end face, a pilot nozzle positioned at the central axis, the pilot nozzle initiating a flame in the burning zone, and wherein the plurality of oxidizer passages are configured to direct oxidizer to create a recirculation zone that anchors the burning zone at the front end face of the nozzle, the recirculation zone being downstream of a point of intersection of the fuel and oxidizer from their respective passages.

11. The combustor of claim 10, wherein a working fluid that is an oxygen-deficient working fluid is included with the combustor.

12. The combustor of claim 10, wherein a series of mixing passages are located within the end cover between the plurality of oxidizer passages and the plurality of cooling flow passages, and wherein the plurality of oxidizer passages and the plurality of cooling flow passages are fluidly connected to one another through the mixing passages.

13. The combustor of claim 10, wherein the end face angle of the front end face ranges from about thirty degrees to about seventy-five degrees when measured from the center axis.

14. The combustor of claim 10, wherein the plurality of oxidizer passages are oriented in an oxidizer angle measured with respect to the front end face of the fuel nozzle, wherein the oxidizer angle is about normal with respect to the front end face.

15. The combustor of claim 10, wherein the plurality of fuel passages are positioned at a fuel angle to orient fuel in the first direction, and wherein the fuel angle ranges between about fifteen to about ninety degrees when measured with respect to the front end face of the fuel nozzle.

16. A gas turbine having a combustor, the combustor comprising:

an end cover having at least one nozzle, the nozzle having a front end face and a center axis, wherein the front end face is oriented at an inclined end face angle measured with respect to the center axis, the nozzle comprising:

a plurality of fuel passages configured for directing fuel in a first direction, wherein the first direction is angled inwardly towards the center axis, fuel exiting the plurality of fuel passages through respective openings located on the front end face;

a plurality of cooling flow passages configured for directing working fluid out of the plurality of cooling flow passages and into the combustor;

a plurality of oxidizer passages configured for directing oxidizer in a second direction, wherein the second direction is angled outwardly away from the center axis, and wherein the plurality of oxidizer passages are oriented in an oxidizer angle measured with respect to the front end face of the fuel nozzle, the plurality of fuel passages and the plurality of oxidizer passages being positioned in relation to one another such that fuel supplied to the combustor is in a cross-flow arrangement with oxidizer to create a burning zone in the combustor, oxidizer exiting the plurality of oxidizer passages through respective oxidizer opening located on the front end face, a pilot nozzle positioned at the central axis, the pilot nozzle initiating a flame in the burning zone, and wherein the plurality of oxidizer passages are configured to direct oxidizer to create a recirculation zone that anchors the burning zone at the front end face of the nozzle, the recirculation zone being downstream of a point of intersection of the fuel and oxidizer from their respective passages.

17. The gas turbine of claim 16, wherein the end face angle of the front end face ranges from about thirty degrees to about seventy-five degrees when measured from the center axis.

18. The gas turbine of claim 16, wherein and wherein the fuel angle ranges between about fifteen degrees to about ninety degrees when measured with respect to the front end face of the fuel nozzle.

* * * * *